US006536768B2

(12) United States Patent
Caputo

(10) Patent No.: US 6,536,768 B2
(45) Date of Patent: Mar. 25, 2003

(54) CASINO POKER GAME WITH PROGRESSIVE JACKPOT

(76) Inventor: Michael Caputo, 92 Yellowpine Crescent, Woodbridge Ontario (CA), L4L 3G9

( * ) Notice: Subject to any disclaimer, the term of this patent is extended or adjusted under 35 U.S.C. 154(b) by 0 days.

(21) Appl. No.: 09/986,793

(22) Filed: Nov. 13, 2001

(65) Prior Publication Data

US 2002/0084586 A1 Jul. 4, 2002

Related U.S. Application Data

(60) Provisional application No. 60/248,230, filed on Nov. 15, 2000.

(51) Int. Cl.[7] ..... A63F 1/00

(52) U.S. Cl. ..... 273/292; 463/13; 463/26; 463/27

(58) Field of Search ..... 273/292, 274, 273/309; 463/12, 13, 26, 27

(56) References Cited

U.S. PATENT DOCUMENTS

| | | | | | |
|---|---|---|---|---|---|
| 4,648,604 | A | | 3/1987 | Horan | |
| 4,743,022 | A | | 5/1988 | Wood | |
| 4,836,553 | A | | 6/1989 | Suttle et al. | |
| 5,067,724 | A | | 11/1991 | Rinkavage | |
| 5,078,405 | A | | 1/1992 | Jones et al. | |
| 5,288,081 | A | | 2/1994 | Breeding | |
| 5,417,430 | A | * | 5/1995 | Breeding | 273/292 |
| 5,718,430 | A | * | 2/1998 | Aramapakul et al. | 273/292 |
| 5,845,907 | A | * | 12/1998 | Wells | 273/292 |
| 5,865,437 | A | * | 2/1999 | Moore, Jr. | 273/292 |
| 5,901,958 | A | | 5/1999 | Andrews | |
| 5,964,464 | A | | 10/1999 | Jones | |
| 5,975,529 | A | * | 11/1999 | de Keller | 273/292 |

* cited by examiner

*Primary Examiner*—Benjamin H. Layno

(57) ABSTRACT

A variation on casino poker requires each player to place a multi-part bet on the table at the outside of a round. At that point, each player can elect to qualify for a progressive jackpot and special prizes by making a further qualifying wager. Three cards are dealt out to each player and to the dealer, whose gives each player the choice of withdrawing or leaving successive parts of the bet as the cards before the dealer are turned over. Only those players who have participated in jackpot betting have the option of using the third card dealt to the dealer as the "sixth card" of their overall holding, from which they build their possible five-card poker hand. The combined use of a progressive jackpot and a "sixth" card to determine winning jackpot combinations affords a dimension of play to heighten interest in participating.

6 Claims, 1 Drawing Sheet

CASINO POKER GAME WITH PROGRESSIVE JACKPOT

RELATED APPLICATION

This application replaces provisional application No. 60/248,230 filed on Nov. 15, 2000 and also entitled CASINO POKER GAME WITH PROGRESSIVE JACKPOT.

BACKGROUND OF THE INVENTION

The present invention relates to a method for playing a casino wagering game which is a variation of five-card stud poker.

A number of variations of the very popular five-card stud poker game have been devised as player-versus-dealer games which feature multiple wagering opportunities.

U.S. Pat. No. 4,836,553 and U.S. Pat. No. 4,861,041 (both to Jones et al) disclose variations which are collectively referred to as Caribbean Stud™ poker. In the preferred method of play described in the '553 patent, the game commences with each player placing a preliminary bet ("ante") at a designated location on a table layout. The house dealer deals five cards to each player and to himself, all face down except for one card in the hand of the dealer.

Having viewed his hand and assessed his chances, each player can elect to retire from the round at that point (to "fold") in which event he forfeits his amount of the ante to the house. The alternative is for the player to make an additional bet—typically prescribed by house rules to be double the amount originally anted—whereupon the dealer reveals his entire hand. Provided that the dealer's hand has a poker value of at least Ace-King, the game progresses with the dealer comparing his hand to that of each pair and paying or collecting bets as appropriate. Poker hands of two pair or better are rewarded by payment of better than even odds on such hand of a winning player.

The aforementioned U.S. Pat. No. 4,861,041 discloses the optional superaddition to Caribbean Stud™ of a "progressive jackpot" in which a player may at his or her option participate in that jackpot by making an additional jackpot wager of some predetermined amount, e.g. a playing token. The jackpot wagers submitted by all players are cumulated. The jackpot is paid out in whole or in part from time to time on the strength of the poker hand held by the winning jackpot bettor. Insofar as the amounts of the jackpot not won in a hand are carried over to the next, the jackpot is "progressive".

The '041 patent and Jones et al U.S. Pat. No. 5,078,405 disclose totalizing apparatus including slots in which each player may deposit a gaming token towards the jackpot component, if desired and means for increasing or decreasing the jackpot meter as money is paid into or out of the jackpot. These two patents are incorporated herein by reference for their teaching of token-operated apparatus for keeping a running jackpot total.

In another variation of five-card stud poker for casino play, disclosed in U.S. Pat. No. 5,901,858 (Andrews), play is carried out with one or more "royal" decks of twenty cards each—namely the 10's and face cards of each suit. Unlike Caribbean Stud™ described above, only three cards are dealt face down to each player and only two to the house dealer. One of the dealer's cards is displayed as a face-up community card for consideration by each player for use as the fourth card of the player's ultimate five-card poker hand.

Having viewed his or her three cards and the community card, each player has the option of either standing on the "bet" wager which he or she initially placed on the game table or, if optimistic, placing a second (equivalent) "additional" wager on the "play" position and turning the three cards of the hand face up. That done, the dealer turns up the second of dealer's two cards as a second community card. The negative five-card poker hand of all players are evaluated and payouts are made according to a payout table.

A rather different wagering game method, commonly referred to as "Let it Ride" is described in U.S. Pat. No. 5,288,081 (Breeding). Each player must place down three equal bets, whereupon the dealer deals three cards to each player and to himself, but then discards out of play ("burns") one of his three cards, sight unseen, leaving the dealer with only two cards. Alternatively, the dealer may simply deal three cards down to each player and refrain from dealing himself a third card.

At that point, each player must decide whether (if pessimistic) to take back the first of his or her three bets or else to "let it ride". The dealer then turns up one of the two community cards so that each player, now in effect in possession of four cards of the ultimate five-card hand, is put to a decision whether to withdraw the second bet from the table or to let that bet ride. The third bet is not retrievable When dealer then turns over the second and last of his cards, play comes to an end, the players show their cards, and all bets still on the table are resolved and distributed according to the poker ranking of each bettor's hand.

It is an object of the present invention to provide a casino variation of five-card stud which combines the simplicity of play and excitement of "Let it Ride" with the appeal of progressive jackpot wagering that is featured in games such as Caribbean Stud™.

DESCRIPTION OF THE INVENTION

Figure 1:
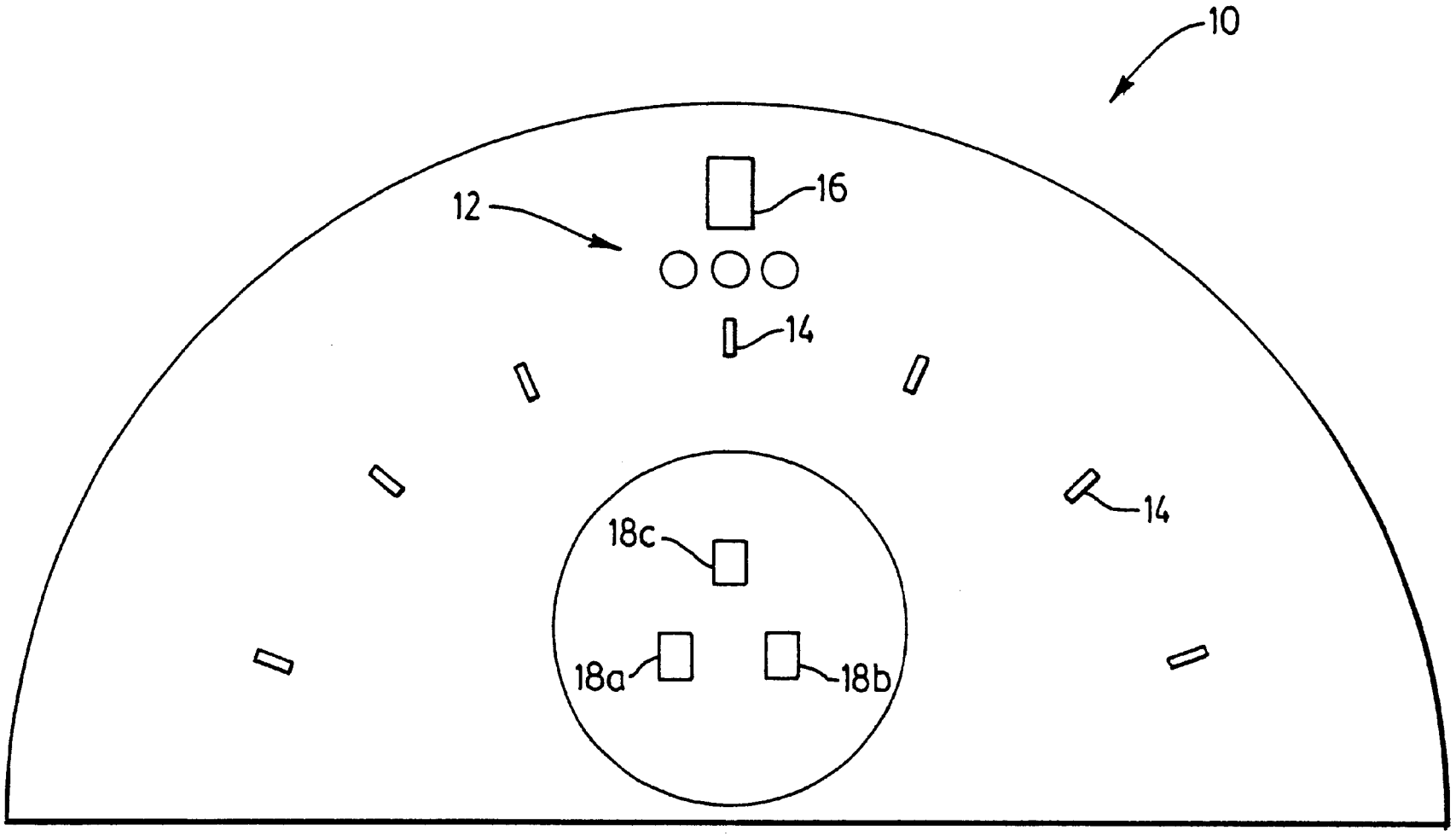
FIG. 1 shows schematically a top plan view of a game table of the present invention.

I have devised a new poker style card game, with progressive jackpot that I have provisionally entitled "Crossfire". The sole drawing FIG. 1 shows schematically a top plan view of a Crossfire table 10 set up for a dealer and seven players. Each player at the table is provided with three wager spaces 12 for his or her three initial bets and a wager slot 14 to accommodate a coin or token for an optional buy-in to jackpot play, as will be described below. The wager spaces 12 and card location 16 are indicated in the Figure only for the fourth player, but the space and locations are located at all seven player positions.

According to a preferred embodiment of the invention, a standard fifty-two card deck is used and the game involves standard poker hand rankings. Each player is required to place three bets at designated locations (not shown) in front of him or her on the table. It is at that point, i.e. prior to commencement of the round, that each player can elect to qualify for the progressive jackpot and special prizes by inserting a coin or token in a slot provided in his or her assigned area on the gaming table. Insertion of the coin or token actuates a totalizing apparatus which may be, for example, of the kind described in U.S. Pat. No. 4,861,041 and currently used in casinos featuring the game of Caribbean Stud™.

Then, as in Let it Ride, three cards are dealt out to each player, to table positions 16 and to the dealer at positions 18*a*, 18*b* and 18*c*. Instead of "burning" his third card, however, the dealer places all three cards face down in front of him as communal cards. Each player then decides, on the strength or weakness of the three cards in his or her hand, whether to let the first bet stand or to take it back. Only then does dealer turn over the first card 18*a*, whereupon each player must decide whether to let the second bet stand, or else take it back. The third bet must stay in as a minimum wager and the player places his or her three cards face down on the table, below that third wager, signifying the end of betting.

Dealer then turns over the second community card, 18*b*, each player's cards are turned over and winning hands are paid out according to a posted schedule. Non-winning wagers are taken by the house. Then the third community card 18*c* is turned over. However, it is only those players who have exercised the option of dropping a coin or token in the "jackpot" slot and who qualify to participate in the jackpot, who may use the third card of the dealer's hand in their own.

This third community card 18*c* may be viewed as the "sixth card" in each jackpot-betting player's hand. Reference to a "six-card hand" is made in quotation marks to emphasize that each player must make up his or her final poker hand using the three cards he or she was dealt and only two of the communal cards.

Each player who did not pay into the jackpot prior to commencement of the round receives a payoff on a winning hand for the third bet portion and for those first and second portions that he or she did not withdraw. The payoff is resolved according to a "regular" pay table listing increasingly long odds for five-card poker hands of increasing rank. The regular pay table will typically award even money to a player whose holding is one pair (tens or better) up to, say, one thousand to one for a royal flush, the poker hand of highest possible rank. Bets made on non-winning hands are, of course, collected for the house by the dealer.

There is also posted a separate "jackpot" payout schedule for winning "six-card" hands, on the basis of which the dealer pays out winnings on the optional jackpot wager. All prizes awarded to those participating players who did wager the optional coin or token are deducted from the jackpot. The amount of the jackpot is always on display on an electronic poster.

The shortened odds on getting a good five-card poker hand when one has a sixth card to choose from are, of course, reflected in the statistically calculated jackpot payout table. A numerical example of jackpot prizes which might be paid out corresponding to particular hands in given in tabular form below, for the purpose of example only.

| Final Poker Hand of Player | Non Use of 3rd card in Front of Dealer | Use of 3rd Card in Front of Dealer |
|---|---|---|
| ROYAL FLUSH | 100% OF JACKPOT | 40% OF JACKPOT |
| STRAIGHT FLUSH | 10% OF JACKPOT | 5% OF JACKPOT |
| FOUR OF A KIND | $500.00 | $200.00 |
| FULL HOUSE | $100.00 | $50.00 |

It is the combined use of a progressive jackpot and the aforementioned "sixth" card to determine winning jackpot combinations which distinguishes CROSSFIRE from Let it Ride and other casino poker games, and which adds an entirely new and exciting dimension of play to the game. Players at the casino will see the jackpot mounting before they sit down at the table. At the same time, my game affords the casino the opportunity to promote a new card game having a progressive jackpot, for attracting more players to the game.

It will be appreciated that variations and modifications of the game specifically described herein could be made without departing from the essential character of the invention. Accordingly, the true scope of the invention is not be limited to the foregoing description, but is defined in the following claims.

What is claimed is:

1. A method of playing a casino game of poker for a house dealer and a number of players, using a standard deck of fifty-two playing cards, each round of the game comprising the steps of:

(a) each player anteing an initial bet in three parts to participate in the round;

(b) each player optionally joining in a contest for a share of a progressive jackpot maintained by the dealer, by placing a further qualifying wager;

(c) the dealer dealing three cards face down to each player and three community cards face down to a designated area, of which two are available for use by all players and the third is a jackpot card available for use only by those players who have placed said further qualifying wager;

(d) each player inspecting and determining on the strength of his own potential poker hand either to withdraw the first part of his initial bet or to leave it at risk in the final resolution of all hands;

(e) the dealer then turning over and showing the first community card and giving players the option of withdrawing or leaving at risk the second part of said initial bet;

(f) the dealer then turning over and showing the second community card to the players, said second community card completing a five-card poker hand for each player participating in the round and resolving the non-withdrawn parts of each player's wager on the basis of the ranking of his five-card poker hand;

(g) the dealer then turning over and showing the jackpot card, offering each player participating in said jackpot contest the use of the jackpot card to improve his five-card poker hand by replacing either of the first two community cards by the jackpot card; and (h) resolving the participation, of each jackpot player, if any, in the jackpot on the basis of the ranking of his final poker hand and according to the first payout table or a second payout table depending on the negative use or non-use of said jackpot card to establish his hand.

2. The method of claim 1, wherein said first, second and third portions of the initial wager are equal.

3. The method of claim 1, wherein the amount paid to each player who has not participated in the jackpot is determined on the basis of a table of odds assigned to various standard poker hands.

4. The method of claim 1, wherein the amount paid to each player participating in the jackpot is determined on the basis of a posted jackpot table.

5. The method of claim 4, wherein said jackpot table assigns fixed monetary payouts to winning hands below a selected ranking and a specified percentage of the jackpot total to winning hands of said selected ranking or higher.

6. The method of claim 4, wherein the total value of the jackpot is continually calculated by totalizing apparatus and displayed on an electronic poster.

* * * * *